US009142910B2

(12) United States Patent
Yu et al.

(10) Patent No.: US 9,142,910 B2
(45) Date of Patent: Sep. 22, 2015

(54) ELECTRICAL CONNECTOR WITH IMPROVED SPACER FOR HEAT DISSIPATION

(71) Applicant: ALLTOP ELECTRONICS (SUZHOU) LTD., Taicang, JiangSu Province (CN)

(72) Inventors: Wang-I Yu, Jhonghe (TW); Hung-Chi Tai, Jhonghe (TW); Chun-Hsien Wu, Jhonghe (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 14/226,128

(22) Filed: Mar. 26, 2014

(65) Prior Publication Data

US 2015/0171545 A1 Jun. 18, 2015

(30) Foreign Application Priority Data

Dec. 12, 2013 (CN) ..... 2013 1 0671167

(51) Int. Cl.

| | |
|---|---|
| ***H01R 13/00*** | (2006.01) |
| ***H01R 13/533*** | (2006.01) |
| ***H01R 13/11*** | (2006.01) |
| ***H01R 13/26*** | (2006.01) |
| ***H01R 13/6582*** | (2011.01) |

(52) U.S. Cl.

CPC ..... *H01R 13/533* (2013.01); *H01R 13/11* (2013.01); *H01R 13/26* (2013.01); *H01R 13/6582* (2013.01)

(58) Field of Classification Search

CPC ..... H01L 23/4006; F21V 29/004; H01R 23/7073; H05K 9/0058

USPC ..... 439/485, 487, 79, 607.21, 607.4, 439/607.32, 607.65, 607.5

See application file for complete search history.

(56) References Cited

U.S. PATENT DOCUMENTS

| | | | | |
|---|---|---|---|---|
| 7,578,696 | B2 * | 8/2009 | Yuan | 439/485 |
| 8,393,917 | B2 * | 3/2013 | Regnier | 439/485 |
| 8,613,632 | B1 * | 12/2013 | Nichols | 439/607.21 |
| 2008/0019100 | A1 * | 1/2008 | Yang | 361/716 |
| 2015/0011103 | A1 * | 1/2015 | Yu et al. | 439/64 |

* cited by examiner

*Primary Examiner* — Hae Moon Hyeon
(74) *Attorney, Agent, or Firm* — Sughrue Mion, PLLC

(57) ABSTRACT

An electrical connector includes a housing, a number of contacts received in the housing and a spacer for holding the contacts. The housing includes a mating portion and a pair of extensions extending from the mating portion. The pair of extensions and the mating portion jointly form a receiving space to receive the spacer. The spacer includes a horizontal portion and a vertical portion perpendicular to the horizontal portion. The horizontal portion defines a slot through which the contacts extend. The vertical portion includes an inner wall, an outer wall and a channel extending through the inner wall and the outer wall. The outer wall defines a recess opening in communication with the channel. When the contacts are associated with the spacer, the contacts are partly exposed to the recess opening via the channel for robust heat dissipation.

20 Claims, 9 Drawing Sheets

ELECTRICAL CONNECTOR WITH IMPROVED SPACER FOR HEAT DISSIPATION

BACKGROUND OF THE INVENTION

1. Field of the Invention

The present invention relates to an electrical connector for being mounted to a circuit board, and more particularly to an electrical connector with an improved spacer for heat dissipation.

2. Description of Related Art

With rapid development of electronic technologies, electrical connectors have been widely used in electronic devices for exchanging information and data with external devices. A conventional QSFP connector usually includes an insulative housing, a plurality of contacts received in the insulative housing, a spacer for organizing the contacts and a metallic shielding cage enclosing the insulative housing. Each contact includes a soldering portion extending beyond the insulative housing for being soldered to a circuit board.

However, since the spacer and the contacts are wholly embedded, the air permeability of spacer of the conventional QSFP connector is poor. As a result, heat generated by the contacts cannot be easily dissipated to the air, thereby decreasing the working life of the QSFP connector.

Hence, an electrical connector with an improved spacer for robust heat dissipation is desired.

BRIEF SUMMARY OF THE INVENTION

The present invention provides an electrical connector including an insulative housing, a plurality of contacts received in the insulative housing and a spacer for holding the contacts. The insulative housing includes a mating portion and a pair of extensions extending rearwardly from the mating portion. The pair of extensions and the mating portion jointly form a receiving space to receive the spacer. The spacer includes a horizontal portion and a vertical portion perpendicular to the horizontal portion. The horizontal portion defines a slot through which the contacts extend. The vertical portion includes an inner wall, an outer wall and a channel extending through the inner wall and the outer wall. The outer wall defines a recess opening in communication with the channel. When the contacts are associated with the spacer, the contacts are partly exposed to the recess opening via the channel for robust heat dissipation.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENT

Figure 1:
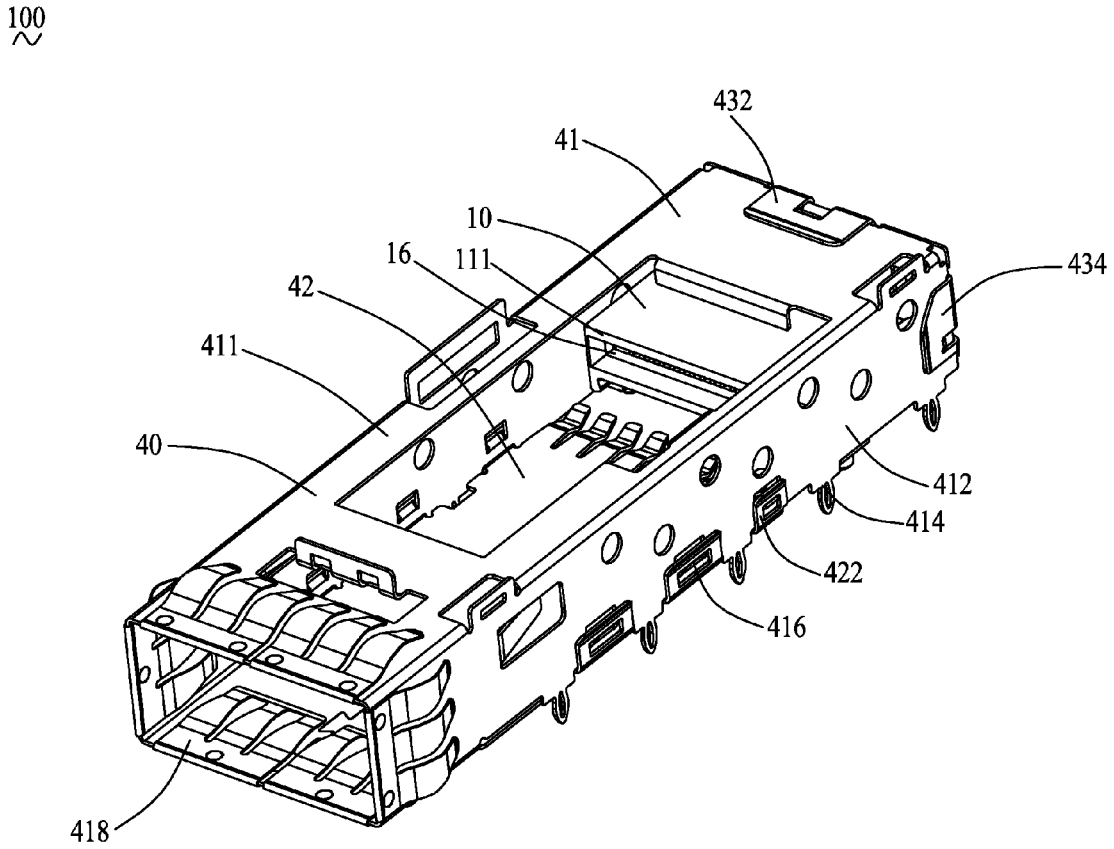
FIG. 1 is a perspective view of an electrical connector in accordance with an illustrated embodiment of the present invention.

Reference will now be made to the drawing figures to describe the embodiments of the present invention in detail. In the following description, the same drawing reference numerals are used for the same elements in different drawings.

Figure 2:
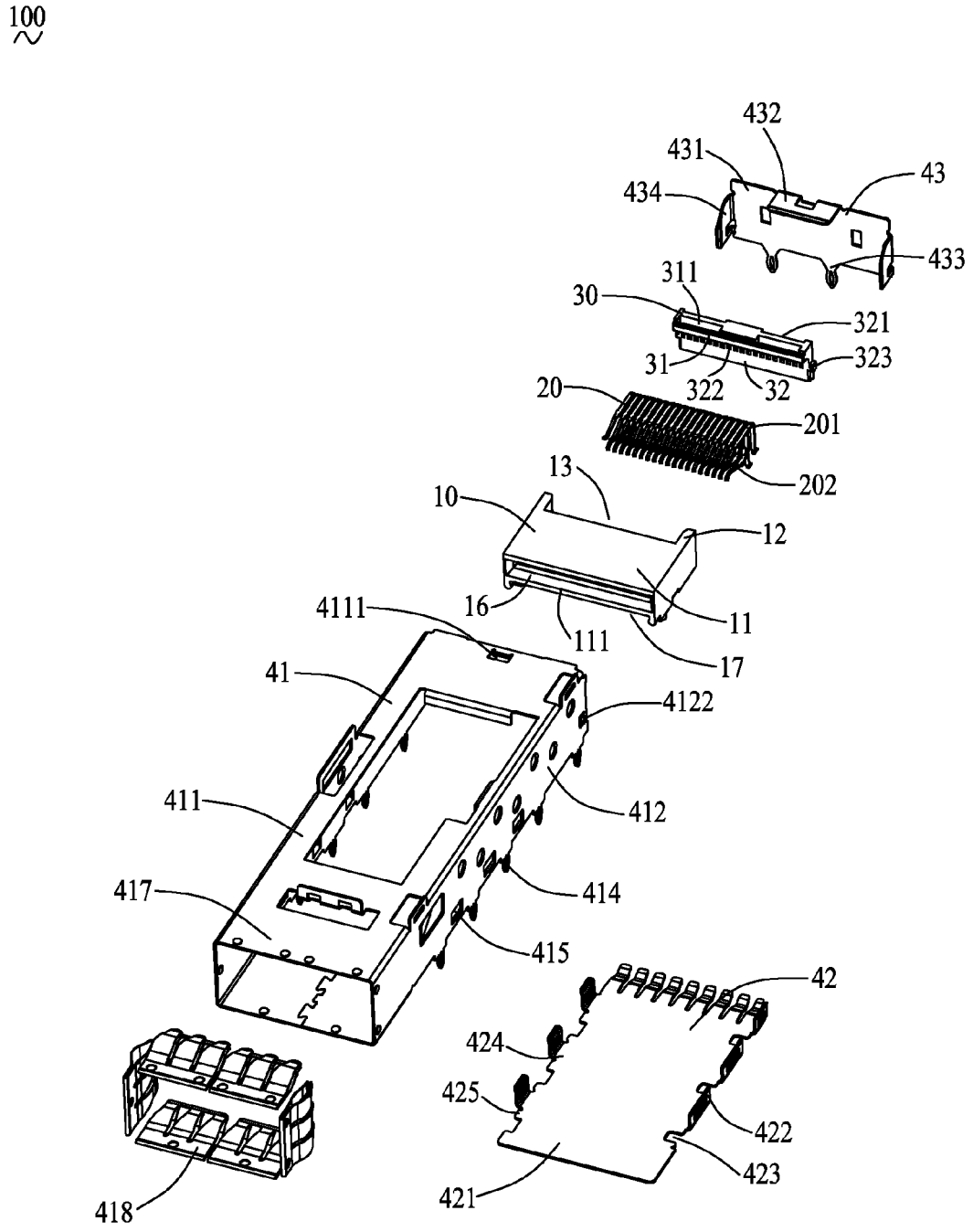
FIG. 2 is an exploded view of the electrical connector as shown in FIG. 1.

Referring to FIGS. 1 and 2, the present invention discloses an electrical connector 100 for being mounted on a circuit board (not shown) for receiving a mating plug (not shown). The electrical connector 100 is a QSFP (Quad Small Formfactor Pluggable) connector according to an illustrated embodiment of the present invention. The electrical connector 100 includes an insulative housing 10, a plurality of contacts 20 retained in the insulative housing 10, a spacer 30 for fixing the contacts 20 and a shielding cage 40 enclosing the insulative housing 10. The contacts 20 include a plurality of first/upper contacts 201 and a plurality of second/lower contacts 202.

Referring to FIGS. 1 to 4, the insulative housing 10 includes a mating portion 11 and a pair of extensions 12 extending rearwardly from lateral sides of the mating portion 11. The pair of extensions 12 and the mating portion 11 jointly form a receiving space 13 for receiving the spacer 30. The mating portion 11 includes a mating surface 111 and a mounting surface 112 opposite to the mating surface 111. The mounting surface 112 is located between the mating portion 11 and the receiving space 13.

The mating portion 11 defines a mating slot 16 extending forwardly through the mating surface 111 and a receiving slot 17 under the mating slot 16. The mating slot 16 and the receiving slot 17 are cooperatively adapted for receiving the mating plug. Besides, the mating portion 11 includes a plurality of passageways extending through the mounting surface 112. The passageways are in communication with the receiving space 13 for receiving the contacts 20. In accordance with the illustrated embodiment of the present invention, the passageways include a plurality of first/upper passageways 14 for receiving the first contacts 201 and a plurality of second/lower passageways 15 for receiving the second contacts 202.

Figure 3:
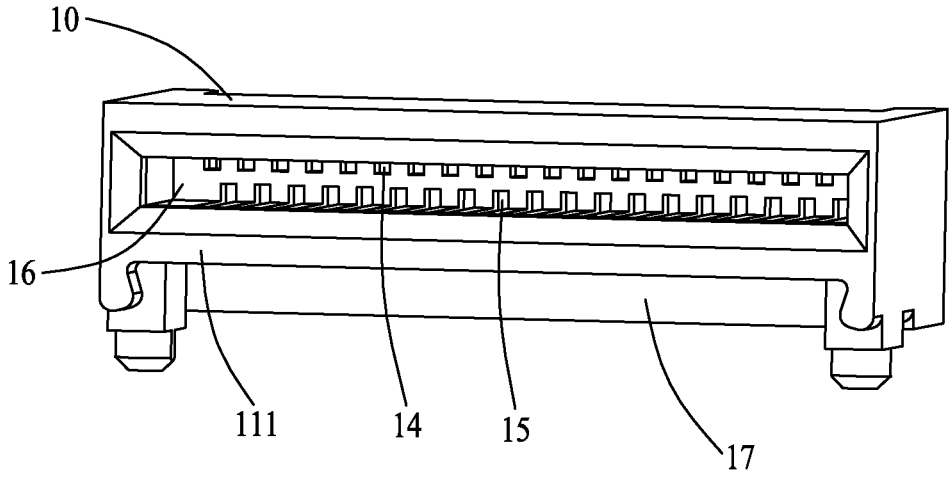
FIG. 3 is a perspective view of an insulative housing of the electrical connector.

Referring to FIG. 3, the upper passageways 14 and the lower passageways 15 are in communication with the mating slot 16. The upper passageways 14 and the lower passageways 15 are offset from each other along a vertical direction of the insulative housing 10.

Figure 4:
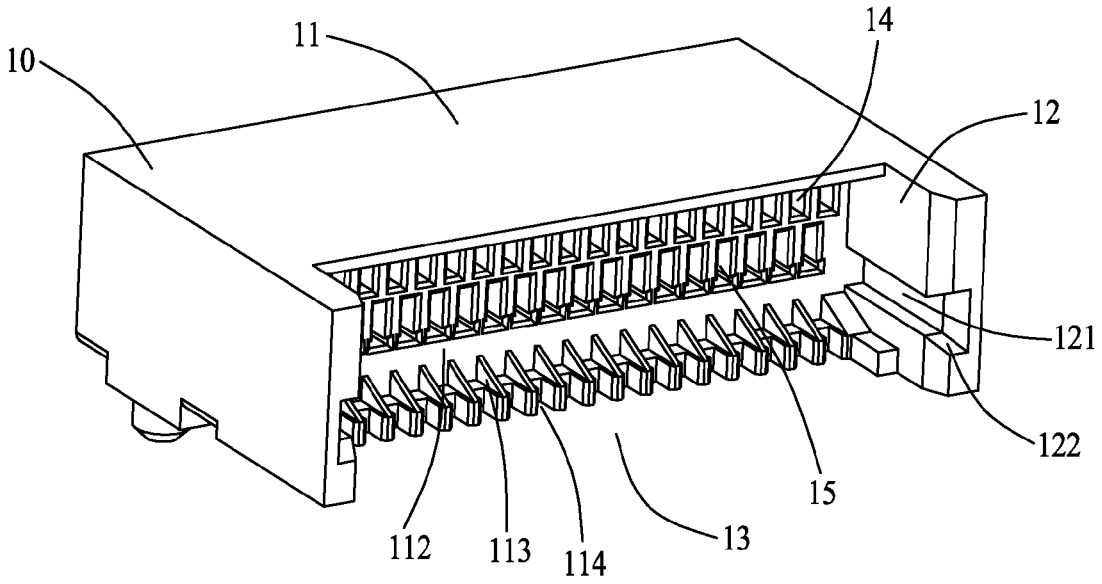
FIG. 4 is another perspective view of the insulative housing as shown in FIG. 3 while taken from a different aspect.
Figure 5:
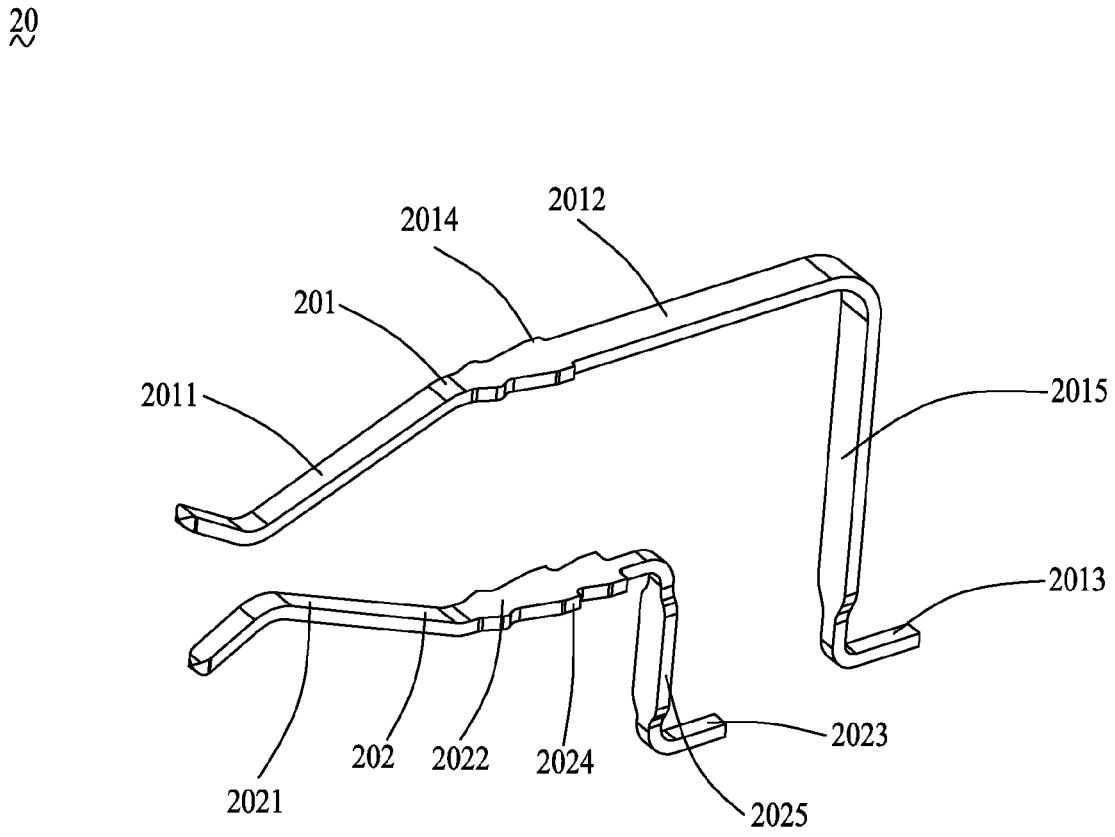
FIG. 5 is a perspective view of a pair of contacts as shown in FIG. 2.
Figure 6:
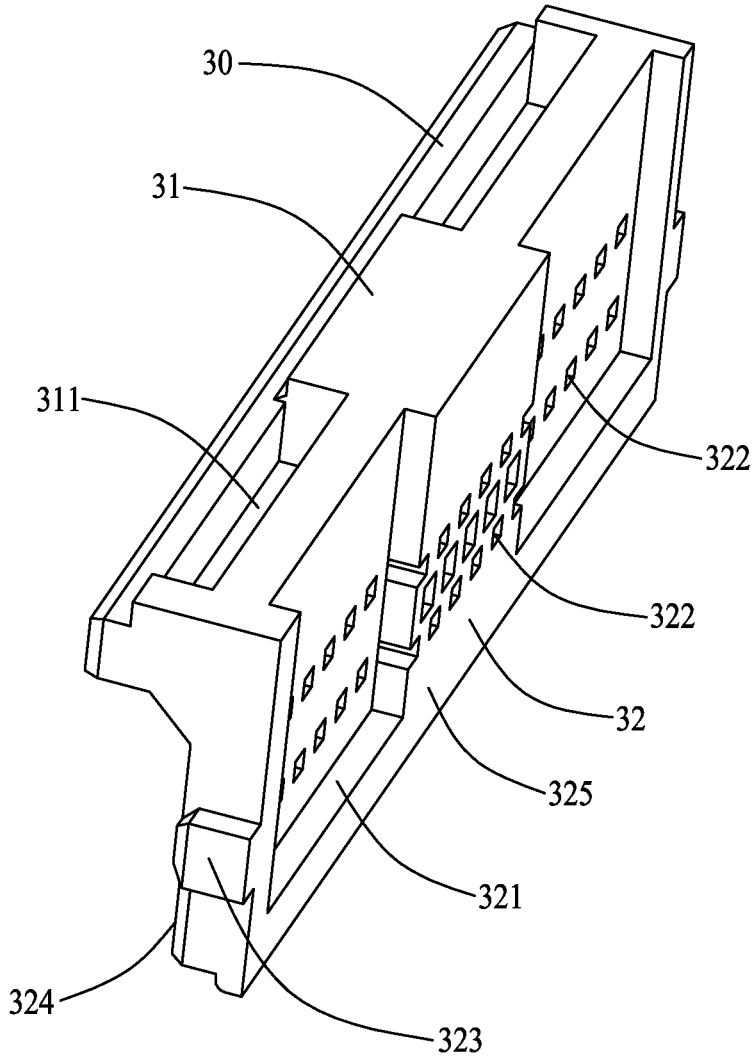
FIG. 6 is a perspective view of a spacer as shown in FIG. 2.
Figure 7:
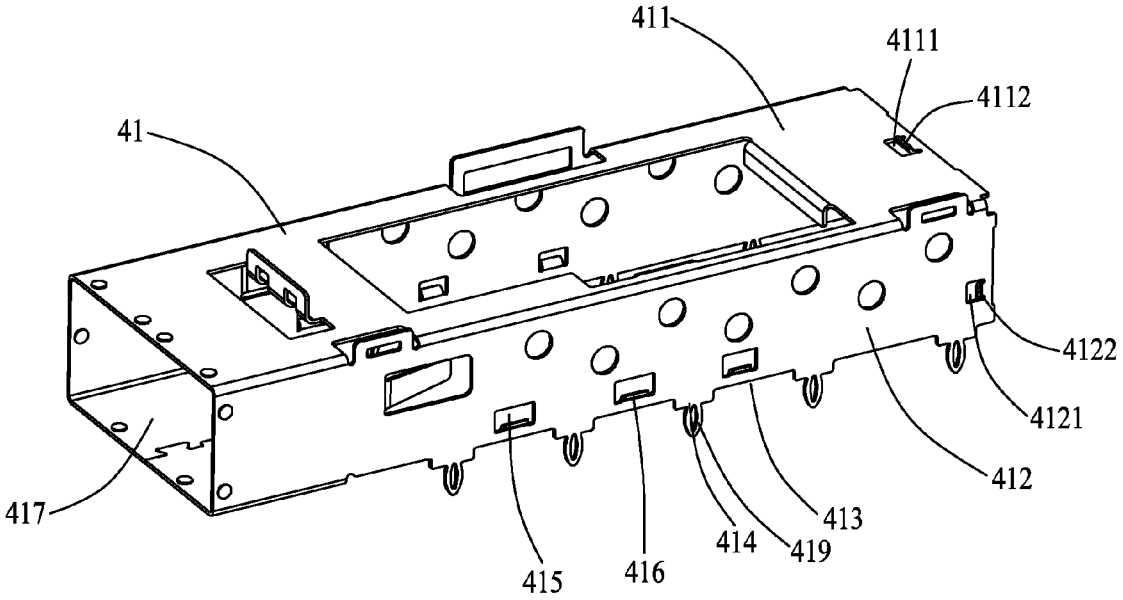
FIG. 7 is a perspective view of a first cage as shown in FIG. 2.
Figure 8:
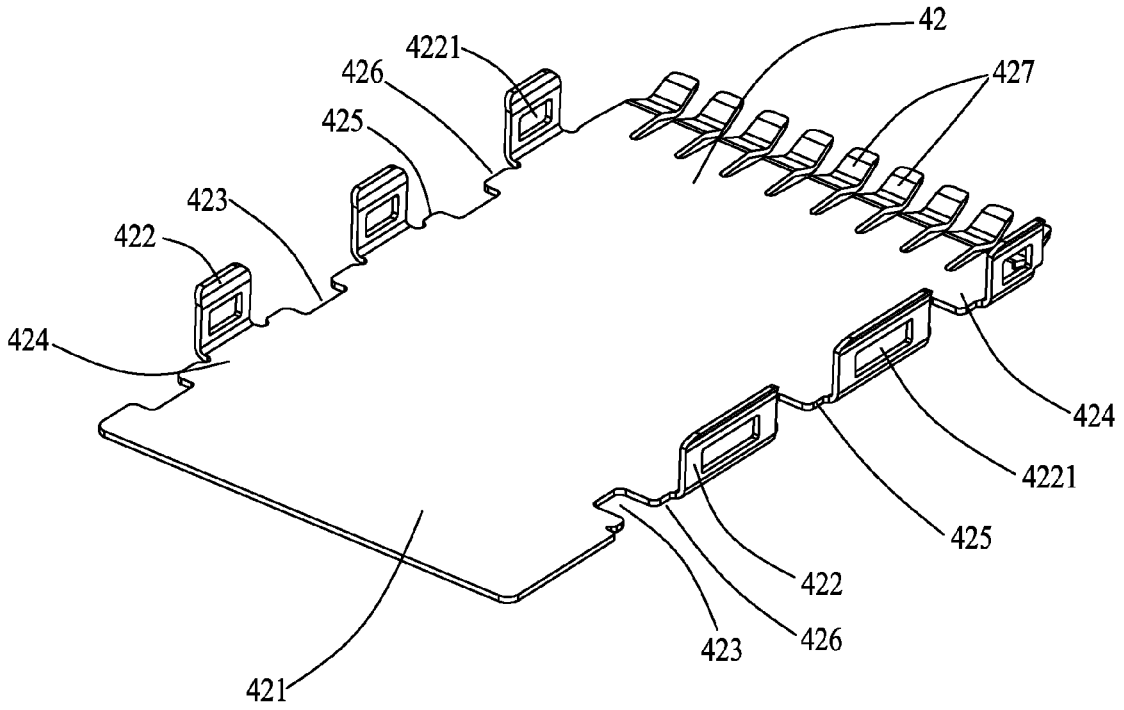
FIG. 8 is a perspective view of a second cage as shown in FIG. 2.

Referring to FIG. 4, the insulative housing 10 further includes a plurality of triangle shaped protrusions 113 at a rear of the mating portion 11. The protrusions 113 are connected to the mounting surface 112. Besides, a plurality of separate slots 114 are formed between each adjacent two protrusions 113 in order to position the contacts 20. In the illustrated embodiment of the present invention, the separate slots 114 are corresponding to the lower passageways 15 and extending through t the insulative housing 10 along the vertical direction. Each extension 12 defines a position slot 121. The pair of position slots 121 are symmetrical with each other and each position slot 121 includes a slant guiding surface 122 for assembling the spacer 30.

Referring to FIGS. 2 to 5, the first contacts 201 are received in the first passageways 14. Each first contact 201 includes a first contacting section 2011 for mating with the mating plug, a first soldering section 2013 for being soldered to a circuit board, a first fixing section 2012 extending backwardly from the first contacting section 2011, and a first bending section 2015 connected between the first fixing section 2012 and the first soldering section 2013.

The first contacting section 2011 is curved and elastic. When the first contacting section 2011 is received in the first passageway 14, the first contacting section 2011 partly extends into the mating slot 16 so as to mate with the mating plug. Each first fixing section 2012 includes a plurality of first barbs 2014 on lateral sides thereof for engaging with inner sides of the first passageway 14 in order to prevent the first contacts 201 from withdrawing the first passageways 14.

The second contacts 202 are received in the second passageways 15. Each second contact 202 includes a second contacting section 2021 for mating with the mating plug, a second soldering section 2023 for being soldered to the circuit board, a second fixing section 2022 extending backwardly from the second contacting section 2021, and a second bending section 2025 connected between the second fixing section 2022 and the second soldering section 2023.

The second contacting section 2021 is curved and elastic as well. When the second contacting section 2021 is received in the second passageway 15, the second contacting section 2021 partly extends into the mating slot 16 so as to mate with the mating plug. The second bending sections 2025 are positioned in the separate slots 114 so that the second soldering sections 2023 can be easily soldered to the circuit board. Each second fixing section 2022 includes a plurality of second barbs 2024 on lateral sides thereof for engaging with inner sides of the second passageway 15 in order to prevent the second contacts 202 from withdrawing the second passageways 15.

According to the illustrated embodiment of the present invention, the first contacts 201 and the second contacts 202 are of similar configurations. The first contacting sections 2011 and the second contacting sections 2021 are arranged in a face-to-face manner in order to clamp the mating plug for stable signal transmission. The differences between the first contacts 201 and the second contacts 202 are that the first fixing sections 2012 are much longer than the second fixing sections 2022, and the first bending sections 2015 are much higher than the second bending sections 2025. Each first contact 201 is located between two adjacent second contacts 202.

Referring to FIGS. 2 to 6, the spacer 30 is received in the receiving space 13. According to the illustrated embodiment of the present invention, the contacts 20 are fixed to the spacer 30 through insert molding technology. The spacer 30 is L-shaped and includes a horizontal portion 31 and a vertical portion 32 perpendicular to the horizontal portion 31. The horizontal portion 31 defines a plurality of slots 311 extending therethrough along the vertical direction. Each slot 311 is rectangular and is formed by an enclosed frame. The first fixing sections 2012 are exposed to the slots 311 so that heat generated by the first fixing sections 2012 can be dissipated to the air via the slots 311.

The vertical portion 32 includes an inner wall 324, an outer wall 325 and a plurality of channels 322 extending through the inner wall 324 and the outer wall 325 along a front-to-back direction. The outer wall 325 defines a plurality of recess openings 321 in communication with part of the channels 322. Each recess opening 321 is in alignment with corresponding slot 311 along the front-to-back direction. The recess opening 321 and the corresponding slot 311 are essential of the same width along a left-to-right direction perpendicular to the front-to-back direction. The recess openings 321 extend upwardly through a top surface of the spacer 30. The first bending sections 2015 extend through the vertical portion 32 and are exposed to the recess openings 321 via corresponding channels 322. As a result, heat generated by the first bending sections 2015 can be dissipated to the air via the corresponding channels 322 and the recess openings 321. Besides, the vertical portion 32 includes a pair of position blocks 323 on opposite sides thereof. The position blocks 323 are fixed in the pair of position slots 121 to be held in position.

Referring to FIGS. 2 to 5 and 7 to 9, the shielding cage 40 includes an essentially reverse U-shaped first cage 41, a second cage 42 for mating with the first cage 41 from a bottom side, and a third cage 43 for mating with the first cage 41 from a rear side. The first cage 41 includes a base portion 411 and a pair of restricting portions 412 bent downwardly from opposite lateral sides of the base portion 411. Each restricting portion 412 defines a plurality of recesses 413 at its bottom edge, a plurality of protrusions 414 each formed between the adjacent two recesses 413, and a plurality of hollow press-fit legs 419 extending downwardly from corresponding protrusions 414. Besides, each restricting portion 412 includes a plurality of openings 415 above the recesses 413 and a plurality of bulges 416 protruding outwardly from bottom edges of the openings 415.

The first cage 41 further includes a closed grounding portion 417 opposite to the insulative housing 10. The grounding portion 417 is associated with a plurality of grounding fingers 418 surrounding around. The base portion 411 includes a first slit 4111 opposite to the grounding portion 417 and a first engaging piece 4112 extending upwardly from the first slit 4111. Similarly, each restricting portion 412 includes a second slit 4121 opposite to the grounding portion 417 and a second engaging piece 4122 extending outwardly from the second slit 4121. In the illustrated embodiment of the present invention, the first slit 4111 and the second slit 4121 are of the same configurations, the first engaging piece 4112 and the second engaging piece 4122 are of the same configuration as well.

The second cage 42 includes a shielding plate 421, a plurality of locking arms 422 bent upwardly from opposite lateral sides of the shielding plate 421 and a plurality of recessed engaging portions 425 on lateral sides of the locking arms 422. The shielding plate 421 includes a plurality of rear grounding fingers 427 extending towards the insulative housing 10. When the second cage 42 is assembled to the first cage 41, the locking arms 422 extend through corresponding recesses 413 as a result that the restricting portions 412 are restricted by the engaging portions 425 and the locking arms 422 inside and outside. In detail, the shielding plate 421 defines a plurality of slots 423 and a plurality of engaging pieces 424 each of which is located between the adjacent two slots 423. The locking arms 422 are bent upwardly from outward edges of the engaging pieces 424. Each engaging piece 424 is wider than corresponding engaging arm 422 which extends therefrom. The engaging pieces 424 include the engaging portions 425. The engaging portions 425 are located at opposite sides of the corresponding engaging arm 422 along the front-to-back direction.

The shielding plate 421 defines a plurality of slits 426 outside of corresponding slots 423 which are deeper than the slits 426 along a outside-to-inside direction. The engaging portions 425 are exposed to the slits 426 along an inside-to-outside direction. The press-fit legs 419 extend downwardly through the slits 426 for being mounted to the circuit board. A distance between the opposite engaging arms 422 along the left-to-right direction is wider than that between the restricting portions 412 so that the second cage 42 can be easily assembled to the first cage 41.

Each engaging arm 422 defines a slot 4221 to engage with corresponding bulges 416. In assembling, when the first cage 41 and the second cage 42 are wholly assembled, the locking arms 422 are located outside of corresponding restricting portions 412 so that the corresponding restricting portions 412 are limited along the inside-to-outside direction, while the engaging portions 425 are located inside of corresponding protrusions 414 so that the corresponding restricting portions 412 are ultimately limited along the outside-to-inside direction. As a result, the integral strength of the shielding cage 40 is improved and signal transmission can be protected because of the excellent shielding effect.

Figure 9:
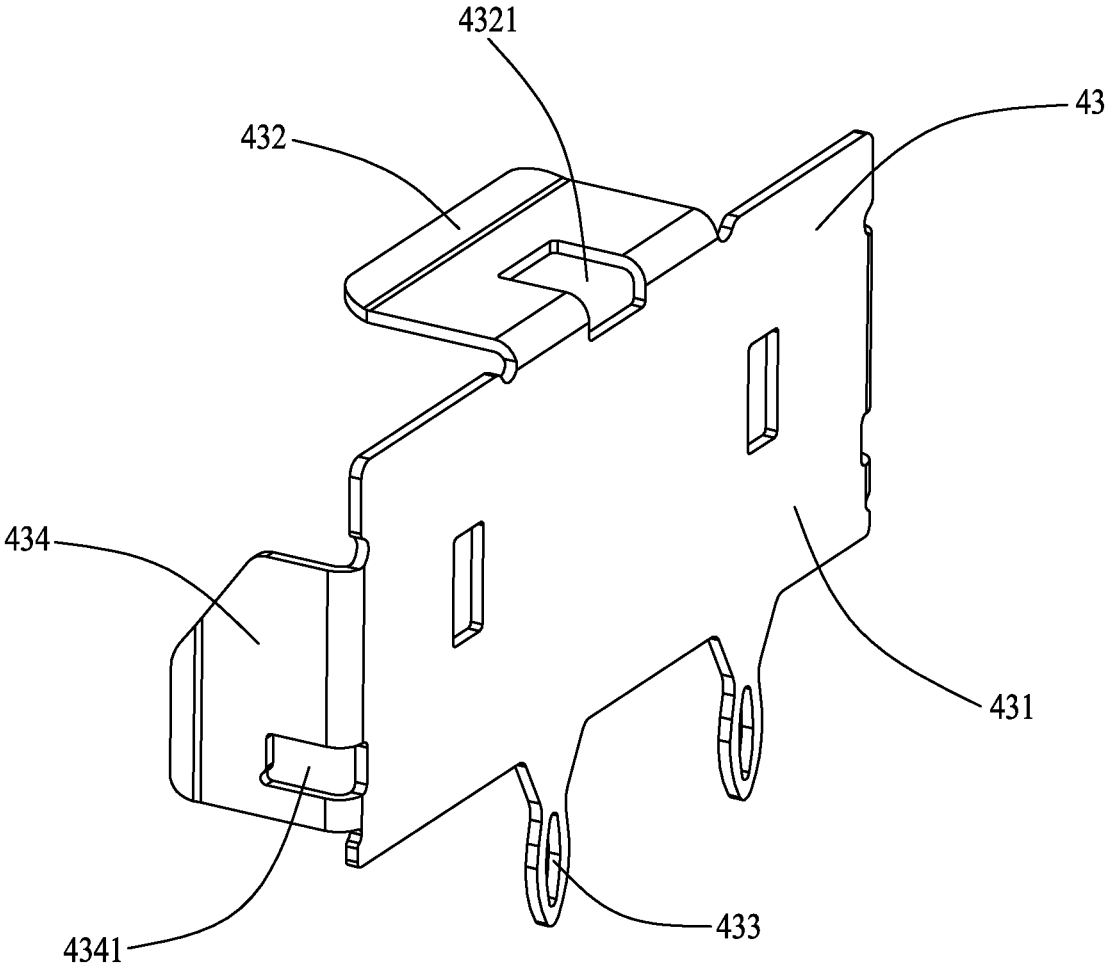
FIG. 9 is a perspective view of a third cage as shown in FIG. 2.

Referring to FIGS. 1, 2 and 9, the third cage 43 includes a shielding portion 431, a first locking portion 432 bent towards the first cage 41, a pair of second locking portions 434 bent towards the first cage 41 from opposite sides of the shielding portion 431, and a plurality of hollow press-fit legs 433 extending downwardly from the shielding portion 431. The first locking portion 432 includes a first slot 4321 for locking with the first engaging piece 4112. Each second locking portion 434 includes a second slot 4341 for locking with the second engaging piece 4122. The first slot 4321 and the second slots 4341 are rectangular shaped. With the first cage 41, the second cage 42 and the third cage 43 combined together, the shielding cage 40 can not only achieve strong integral strength, but also achieve robust shielding effects.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector comprising:

an insulative housing comprising a mating portion and a pair of extensions extending rearwardly from the mating portion, the pair of extensions and the mating portion jointly forming a receiving space;

a plurality of contacts received in the insulative housing; and a spacer received in the receiving space, the spacer comprising a horizontal portion and a vertical portion perpendicular to the horizontal portion, the horizontal portion defining a slot through which the contacts extend, the vertical portion comprising an inner wall, an outer wall and a channel extending through the inner wall and the outer wall, the outer wall defining a recess opening in communication with the channel; wherein when the contacts are associated with the spacer, the contacts are partly exposed to the recess opening via the channel for robust heat dissipation.

2. The electrical connector as claimed in claim 1, wherein the recess opening is in alignment with the slot along a front-to-back direction, and the recess opening and the slot are essential of the same width along a left-to-right direction perpendicular to the front-to-back direction.

3. The electrical connector as claimed in claim 1, wherein the recess opening extends upwardly through a top surface of the spacer.

4. The electrical connector as claimed in claim 1, wherein the slot extends through the horizontal portion along a vertical direction.

5. The electrical connector as claimed in claim 2, wherein the channel extends through the inner wall and the outer wall along the front-to-back direction.

6. The electrical connector as claimed in claim 1, wherein the vertical portion comprises a pair of position blocks on opposite sides thereof, and the extensions define a pair of position slots to hold the position blocks in position.

7. The electrical connector as claimed in claim 1, wherein the mating portion defines a mating slot, a plurality of upper passageways and a plurality of lower passageways, the contacts comprising a plurality of upper contacts received in the upper passageways and a plurality of lower contacts received in the lower passageways, the upper contacts and the lower contacts protruding into the mating slot.

8. The electrical connector as claimed in claim 7, wherein the upper passageways and the lower passageways extend rearwardly through the insulative housing and in communication with the receiving space.

9. The electrical connector as claimed in claim 1, wherein the insulative housing comprises a plurality of triangle shaped protrusions at a rear of the mating portion, a plurality of separate slots being formed between each adjacent two protrusions to position the contacts.

10. The electrical connector as claimed in claim 1, wherein the contacts are fixed to the spacer through insert molding technology.

11. The electrical connector as claimed in claim 1, wherein the slot is rectangular and is formed by an enclosed frame.

12. An electrical connector comprising:

an insulative housing comprising a mating portion and a pair of extensions extending rearwardly from the mating portion, the pair of extensions and the mating portion jointly forming a receiving space, the mating portion defining a mating slot and upper and lower passageways in communication with the mating slot;

a plurality of contacts received in the insulative housing, the contacts comprising a plurality of first contacts having first elastic contacting sections received in the upper passageways and a plurality of second contacts having second elastic contacting sections received in the lower passageways, the first elastic contacting sections and the second elastic contacting sections being arranged in a face-to-face manner and extending into the mating slot;

a spacer received in the receiving space, the spacer comprising a horizontal portion and a vertical portion perpendicular to the horizontal portion, the horizontal portion defining a slot through which the contacts extend, the vertical portion comprising an inner wall, an outer wall and a channel extending through the inner wall and the outer wall, the outer wall defining a recess opening in communication with the channel; and a shielding cage enclosing the insulative housing, the shielding cage comprising a first cage and a second cage for mating with the first cage; wherein the contacts are embedded in the spacer and the contacts are partly exposed to the recess opening via the channel for robust heat dissipation.

13. The electrical connector as claimed in claim 12, wherein the recess opening is in alignment with the slot along a front-to-back direction, and the recess opening and the slot are essential of the same width along a left-to-right direction perpendicular to the front-to-back direction.

14. The electrical connector as claimed in claim 12, wherein the recess opening extends upwardly through a top surface of the spacer.

15. The electrical connector as claimed in claim 12, wherein the slot extends through the horizontal portion along a vertical direction.

16. The electrical connector as claimed in claim 13, wherein the channel extends through the inner wall and the outer wall along the front-to-back direction.

17. The electrical connector as claimed in claim 12, wherein the first cage comprises a base portion and a pair of restricting portions bent downwardly from opposite lateral sides of the base portion, each restricting portion defining a plurality of bottom protrusions and a plurality of press-fit legs extending downwardly from corresponding protrusions; the second cage comprising a shielding plate, a plurality of locking arms bent upwardly from opposite lateral sides of the shielding plate and a plurality of recessed engaging portions on lateral sides of the locking arms; and wherein when the second cage is assembled to the first cage in position, the restricting portions are clamped by the engaging portions and the locking arms inside and outside.

18. The electrical connector as claimed in claim 17, wherein the locking arms are located outside of corresponding restricting portions so that the corresponding restricting portions are limited along an inside-to-outside direction, while the engaging portions are located inside of the corresponding protrusions so that the corresponding restricting portions are limited along an outside-to-inside direction.

19. The electrical connector as claimed in claim 18, wherein each restricting portion comprises a plurality of bulges protruding outwardly therefrom, and each engaging arm defines a slot to engage with corresponding bulges.

20. The electrical connector as claimed in claim 17, wherein the shielding cage comprises a third cage for mating with the first cage at a rear side thereof.

* * * * *